United States Patent [19]

Campbell

[11] Patent Number: 4,967,827

[45] Date of Patent: Nov. 6, 1990

[54] METHOD AND APPARATUS FOR MELTING AND CASTING METAL

[75] Inventor: John Campbell, Worcester, United Kingdom

[73] Assignee: Cosworth Research and Development Limited, Worcester, United Kingdom

[21] Appl. No.: 393,817

[22] Filed: Aug. 15, 1989

Related U.S. Application Data

[63] Continuation of Ser. No. 765,061, Aug. 12, 1985, abandoned, which is a continuation-in-part of Ser. No. 495,508, May 17, 1983, abandoned.

[30] Foreign Application Priority Data

May 20, 1982 [GB] United Kingdom ..... 82/14728
Oct. 16, 1982 [GB] United Kingdom ..... 82/29628

[51] Int. Cl.[5] ..... B22D 35/00

[52] U.S. Cl. ..... 164/134; 164/337; 164/133; 222/591

[58] Field of Search ..... 164/133, 134, 335, 337, 164/437, 306, 119; 222/591, 594, 604, 605

[56] References Cited

U.S. PATENT DOCUMENTS 3,654,150 4/1972 Eccles ..... 164/134

FOREIGN PATENT DOCUMENTS 2061110 6/1971 Fed. Rep. of Germany .
451773 3/1975 U.S.S.R. .
1506425 4/1978 United Kingdom .

OTHER PUBLICATIONS

"Engineering", vol. 221, No. 3, Mar., 1981, London (G.B.).

J. Campbell Production of High Technology Aluminium Alloy Castings, pp. 185–188.

*Primary Examiner*—Richard K. Seidel

*Attorney, Agent, or Firm*—Marshall, O'Toole, Gerstein, Murray & Bicknell

[57] ABSTRACT

A method of melting and casting metal comprising the steps of melting metal in a melting vessel, transferring metal from the melting vessel into a casting vessel by flow of metal under gravity and pumping metal against gravity from the casting vessel into a mold. The level of the top surface of the metal as the metal leaves the melting vessel is above the top surface of the metal in the casting vessel by not more than a maximum distance above which excessive turbulence occurs. The maximum distance lies in the range 50–200 mm.

14 Claims, 4 Drawing Sheets

METHOD AND APPARATUS FOR MELTING AND CASTING METAL

RELATED APPLICATION

This is a continuation of application No. 765061 filed Aug. 12, 1985, now abandoned which a continuation in part of application No. 495,508 filed May 17, 1983 now abandoned.

BACKGROUND OF THE INVENTION

1. Field of the Invention.

This invention relates to a method of, and apparatus for, melting and casting metal. The term "metal" is used herein to include metal alloys.

2. Description of the Prior Art.

A widely used known method of making metal castings comprises the following main steps:

(i) melting is carried out in a melting vessel such as a furnace or large crucible which is then tilted to pour the metal;

(ii) into a smaller transfer crucible or launder in which the metal is transferred to a casting station at which there is a mould, and (iii) casting is carried out by pouring the metal from the transfer crucible or launder into the mould.

Sometimes a modified known method is used in which the metal is poured directly from the furnace into the mould, eliminating the transfer stage (i.e. stage (ii) above.

Less frequently, another modified known method is used in which after melting and pouring into a transfer ladle, metal is poured into a furnace or crucible contained within a pressure vessel. The pressure vessel is sealed and then pressurised by a gas which displaces the liquid metal up a riser tube and into the mould. This method of casting is called low pressure casting. It has the commendable feature that the pouring into the casting is replaced by an upward displacement which is much less turbulent than pouring under gravity. Correspondingly higher quality castings are produced than are produced with pouring under gravity. However, optimum quality is not attainable in oxide-forming metals, such as those containing relatively large quantities of aluminum and magnesium, since surface oxides are entrained within the metal by the turbulence involved in the previous transfers carried out by pouring, and the entrained oxides do not separate quickly from the liquid.

Most of the above described methods result in a total free fall of metal under gravity in one or two steps, occasionally more, through a vertical distance of from 0.50 metres to several metres. The resulting high metal velocities give rise to severe splashing and churning.

In a rarely used known method, the metal is melted in a crucible or furnace connected directly to a mould, the crucible or furnace is then pressurised, or the mould subjected to partial evacuation, so that metal is forced or drawn up into the mould cavity directly. This method of casting eliminates all turbulence from transfers in casting and is therefore capable of making high quality castings in oxidisable alloys. Unfortunately, however, the method by its nature is limited to batch production. Also any treatment of the metal, such as de-gassing by bubbling gases through the liquid, or fluxing by stirring in fluxes, involves the danger of residual foreign material suspended in the liquid metal. There is no intermediate stage in which such defects can conveniently be filtered out. The time usually allowed in consequence in an attempt to allow such impurities to sink or float prior to casting involves a considerable time delay and thus represents a serious reduction in the productivity of the plant.

All of these known methods therefore suffer from the problem of not providing high productivity together with high quality of castings.

An attempt to provide a solution to the above problem is described in Engineering, Vol. 221, No. 3, Mar. 1981, LONDON (GB) J. Campbell "Production of high technology aluminium alloy castings" Pages 185–188.

This discloses a method of melting and casting metal comprising the steps of melting metal in a melting vessel, transferring metal from the melting vessel into a casting vessel by flow of metal under gravity and pumping metal against gravity from the casting vessel into a mould. However, whilst some improvement over previously known methods was experienced, as high productivity with high quality of casting as was desired was not achieved.

SUMMARY OF THE INVENTION

The present invention provides a solution to this problem by providing that a quiescent flow of metal is advanced, by gravity, along the whole of a path from the melting vessel to the casting vessel, the path being defined to maintain the level of the top surface of the metal as the metal leaves the melting vessel above the top surface of the metal in the casting vessel by not more than a distance of 200 mm.

As a result, the metal flows gently from the melting vessel to the casting vessel without high metal velocities and hence without excessive turbulence.

From another aspect, the invention solves the problem by providing in an apparatus for melting and casting metal comprising a melting vessel, a casting vessel, means defining a path for quiescent flow of molten metal under gravity from said melting vessel to said casting vessel so that the level of the top surface of said molten metal as said molten metal leaves said melting vessel is above the top surface of the molten metal in said casting vessel by not more than a distance of 200 mm and a pump to pump metal against gravity from the casting vessel into a mould.

When the level of the top surface of the metal as the metal leaves the melting vessel is above the top surface of the metal in the casting vessel by more than 200 mm, there is an unacceptable deterioration in the properties of castings made from the metal. At 200 mm or below, whilst oxide may be entrained the amount is such that any deterioration in properties of castings made from the metal is tolerable. At 100 mm and below, there is still less deterioration in the properties of the resulting castings and at 50 mm and below there are no deleterious effects whatsoever on the castings in practical terms. Where the levels are substantially the same as a result of the melting vessel comprising a region of the same vessel of which another region comprises the casting vessel unexpectedly better properties are achieved.

The method may include the steps of directing metal from the melting vessel into a launder and from the launder into the casting vessel and of maintaining the level of metal in the launder at a level which is below the level of the top surface of the metal as it leaves the melting vessel and is at or above the level of the top surface of the metal in the casting vessel.

The apparatus may include a launder having an entry end located so that metal leaving the melting vessel may enter the launder thereat and an exit end whereby the metal may flow from the launder to the casting vessel, means being provided to maintain the level of the top surface of the metal in the launder at a level which is below the level of the top surface of the metal as it leaves the melting vessel and is at or above the level of the top surface of the metal in the casting vessel.

The launder and casting vessel may be disposed so that the bottom of the launder is at or below the lowest level which the top surface of the metal in the casting vessel reaches during normal operation. In this case, the launder will always contain metal and hence said level of metal in the launder will be maintained always during normal operation of the method.

Alternatively the bottom surface of the launder may be above the lowest level which the top surface of the metal in the casting vessel may reach during normal operation. In this case, the launder may empty of metal unless metal is fed from the casting vessel continuously.

The bottom surface of the launder may be horizontal or may be inclined so as to fall in the direction towards the casting vessel.

The launder may have a bottom surface which is curved in longitudinal section to provide an entry portion which is more inclined to the horizontal than is an exit portion. As a result, metal leaving the melting vessel engages a part of the launder which is more nearly inclined to the direction of metal fall than other parts of the launder whilst the exit portion of the launder extends horizontally or substantially horizontally. This shape of the launder facilitates non-turbulent flow of the metal.

The larger the surface area of the casting vessel, the larger the size and/or number of castings which can be produced before the casting vessel requires to be topped up from the melting vessel to prevent the distance between said levels increasing to above maximum distance. Moreover, topping up of the casting vessel can occur without interruption to the casting cycle so that production can continue without variation in the rate of production.

Alternatively, the casting vessel and the melting vessel may be provided by different, interconnecting, regions of a casting vessel so that said distance is substantially zero.

The method may be performed so that metal is added to the melting vessel at substantially the same rate as metal is pumped from the casting vessel.

The metal may be transferred from the casting vessel into the mould by an electromagnetic type of pump or a pneumatic type of pump.

A pump of either of the above types has no moving parts and thus avoids any problem of turbulence during the transfer of metal from the casting vessel to the mould.

Filter means may be incorporated in the metal flow path from the melting vessel to the casting vessel.

Where the apparatus includes a launder, the filter means is preferably positioned in the launder or between the launder and the casting vessel.

Where the melting and casting vessels comprise regions of a common vessel, the filter may be positioned between the regions which provide the melting and casting vessels.

By providing a filter means any undesirable impurities in the metal may be removed from the metal before the metal enters the casting vessel.

Thus treatment such as degassing, fluxing, grain refining, alloying, and the like can all take place in the melting vessel since any undesirable impurities resulting from such treatments are removed by the filter means so that the volume of metal from which the castings are drawn is exceptionally clean. In addition, the casting vessel which contains this clean metal also remains clean; consequently reducing maintenance problems which are common with known installations.

When the melting vessel is separate from the casting vessel the melting vessel may be a lip action tilting type furnace arranged so that the lip is at a distance above the liquid metal in the launder, or in the casting vessel when no launder is provided, so that the maximum fall is less than said maximum distance. Such a height difference under conditions of controlled and careful pouring is not seriously detrimental to metal quality and any minor oxide contaminations which are caused may be removed for practical purposes by the above referred to filter means.

Alternatively, the melting furnace may be of the dry sloping hearth type heated by a radiant roof. In this case metal ingots or scrap placed upon the hearth melt and the liquid metal flows into the launder or into the casting vessel, the position at which the metal leaves the furnace being less than said maximum distance above the level of metal in the launder or casting vessel but preferably the furnace includes a portion which extends to said metal level so that the metal does not suffer any free fall through air.

If desired, more than one melting vessel may be provided to feed metal to the casting vessel either by each melting vessel feeding into a single launder or by feeding into separate launders or by feeding into a composite launder having a number of entry channels feeding to a common exit channel or by the melting vessels feeding directly, except for a filter means when provided, into the casting vessel.

It is desirable that all the heating means of the apparatus be powered by electricity since the use of direct heating by the burning of fossil fuels creates water vapour, which in turn can react with the melt to create both oxides on the surface and hydrogen gas in solution in the metal. Such a combination is troublesome by producing porous casting. Such electrical heating means includes the heating means of the melting and holding furnaces, and all the auxiliary heaters such as those which may be required for launders, filter box units, and associated with the pump.

It is also desirable that the melting vessels are of such a type as to reduce turbulence to a minimum. Resistance heated elements arranged around a crucible fulful this requirement well. It is possible that induction heating using a conductive crucible and sufficiently high frequency might also be suitable.

The control of turbulance at all stages in the life of the liquid metal from melting, through substantially horizontal transfer and holding, to final gentle displacement into the mould is found to reduce the nuclei for porosity (whether shrinkage or gas) to such an extent that the metal becomes effectively tolerant of poor feeding. Isolated bosses are produced sound without special extra feeding or chilling requirements.

The invention is applicable to the casting of all metals but has been particularly developed for casting non-ferrous metal, especially aluminium magnesium and alloys thereof.

In general the level of porosity in aluminium alloy castings such as those of Al-7Si -0.5Mg type, is reduced from about 1 vol.% (varies typically between 0.5 and 2 vol.%) to at worst 0.1 vol.% and typically between 0.01 and 0.001 vol.%.

The castings produced by the present invention are characterised by a substantial absence of macroscopic defects comprising sand inclusions, oxide inclusions and oxide films. The presence of compact inclusions such as sand and oxide particles increases tool wear, so that castings produced by the invention have extended tool lives compared with those for equivalent alloys in equivalent heat treated condition. Oxide films cause leakage of fluids across casting walls, and reduce mechanical strength and toughness of materials. Thus casting produced by the invention have good leak tightness and have an increased strength of at least 20% for a given level of toughness as measured by elongation.

Thus very high quality castings become attainable for the first time simultaneously with high productivity. Provided a high quality and accurate mould is used, and provided the alloy chemistry is correct, premium quality castings therefore become no longer the exclusive product of the small volume premium foundry, but can be mass produced.

We have found that unexpectedly good results are obtained when a method and/or apparatus embodying the invention is used to cast an aluminium alloy lying in the following composition range.

| | | | |
|---|---|---|---|
| Si | 10.0 | 1.5 | |
| Cu | 2.5 | 4.0 | |
| Mg | 0.3 | 0.6 | |
| Fe | 0 | 0.8 | |
| Mn | 0 | 0.4 | |
| Ni | 0 | 0.3 | |
| Zn | 0 | 3.0 | |
| Pb | 0 | 0.2 | |
| Sn | 0 | 0.1 | |
| Ti | 0 | 0.08 | |
| Cr | 0 | 0.05 | |
| Usual Incidentals | 0 | 0.09 | each incidental |
| Aluminium | | Balance | |

In a preferred composition, the silicon, copper and magnesium contents may be as follows:

| | | |
|---|---|---|
| Si | 10.5 | 11.5 |
| Cu | 2.5 | 3.5 |
| Mg | 0.3 | 0.5 |

The alloy may be heat treated, for example, by being aged, for example, for one hour to eight hours at 190° C.–210° C. or by being solution heat treated, quenched and aged, for example, for one hour to twelve hours at 490° C.–510° C., water or polymer quenched, and aged for one hour to eight hours at 190° C.–210° C.

The alloy may have the following mechanical properties:

| | 0.2 PS MPa | UTS MPa | El % | Brinell Hardness HB |
|---|---|---|---|---|
| 1 | 130–140 | 190–200 | 1.2–1.4 | 90–100 |
| 2 | 180–200 | 210–220 | 0.8–1.0 | 95–105 |

-continued

| | 0.2 PS MPa | UTS MPa | El % | Brinell Hardness HB |
|---|---|---|---|---|
| 3 | 300–330 | 300–340 | 0.5–0.8 | 110–140 |

where line 1 is "as cast"; line 2 "as aged", line 3 as solution heat treated, quenched and aged.

According to another aspect of the invention, we provide an article made by low pressure casting in an alloy lying in the above composition range and made by the method and/or apparatus according to the first two aspects of the invention.

An examination of the costs of the production of secondary aluminium alloys reveals that each element exhibits a minimum cost at that level at which it normally occurs in scrap melts. The cost rises at levels above (since more has to be added, on average) and below (since the alloy has to be diluted with 'purer' scrap or with expensive 'virgin' or 'primary' aluminium metal or alloy). The approximate minima for lowest cost are:

| | | |
|---|---|---|
| Si | 6.0 | 7.0 |
| Cu | 1.5 | |
| Mg | 0.5 | 1.0 |
| Fe | 0.7 | |
| Mn | 0.3 | |
| Ni | 0.15 | |
| Zn | 1.5 | |
| Pb | 0.2 | |
| Sn | 0.1 | |
| Ti | 0.04 | 0.05 |
| Cr | 0.02 | 0.05 |
| P | 20 ppm. | |

It will be seen that the levels of the constituents of an alloy according to the invention are substantially at the above indicated minimum cost level thereby being economical to produce.

The principal alloying elements in an alloy embodying the invention are silicon which mainly confers castability with some strength, and copper and magnesium which can strengthen by precipitation hardening type of heat treatments.

To obtain the desired ageing response on ageing, copper must be in excess of approximately 2.5%. An undesirable extension of the freezing range occurs with copper contents above 3.5 to 4.0% which detracts from castability and the incidence of shrinkage defects, porosity and hot tearing increases.

A useful gain in strength is derived from controlling magnesium levels optimally in the range 0.3–0.5%. Below this range strength falls progressively with further decrease in magnesium. Above this range the rate of gain of strength starts to fall significantly and at the same ductility contrinues to decrease rapidly, increasing the brittleness of the alloy.

Titanium is normally added to increase mechanical properties in aluminium alloys but we have found unexpectedly that titanium is deleterious above 0.08%.

The other alloying constituents are not detrimental in any significant way to the properties of the alloy within the range specified, the alloy thus achieves high performance.

For good castability it is desirable that the alloy is of eutectic composition which provides a zero or narrow freezing range. The reasons for this include:

(a) lower casting temperatures, reducing hydrogen pick-up, oxidation and metal losses, and raising productivity by increasing freezing rate of the casting in the mould;

(b) increased fluidity, enabling thinner sections to be cast over larger areas, without recourse to very high casting temperatures;

(c) because of the 'skin-freezing' characteristics of solidification of eutectic alloys (as contrasted with pasty freezing of long freezing range alloys), any porosity is not usually linked to the surface and so castings are leak-tight and pressure-tight. This is vital for many automobile and hydraulic components. The concentrated porosity which might be present in the centre of an unfed or poorly fed section can be viewed as usually relatively harmless, or can in any case be relatively easily removed by the foundryman. The castings in such alloys tend therefore to be relatively free from major defects.

In an alloy according to the invention, a copper content lying in the range 2.5 to 4% and a silicon content of 10 to 11.5% provides a eutectic or substantially eutectic composition. At higher silicon levels primary silicon particles appear which adversely affect machinability. Thus the exceptionally good castability mentioned above is achieved.

BRIEF DESCRIPTION OF THE DRAWINGS

Embodiments of the invention will now be described by way of example, with reference to the accompanying drawings wherein.

DESCRIPTION OF THE PREFERRED EMBODIMENTS

Figure 1:
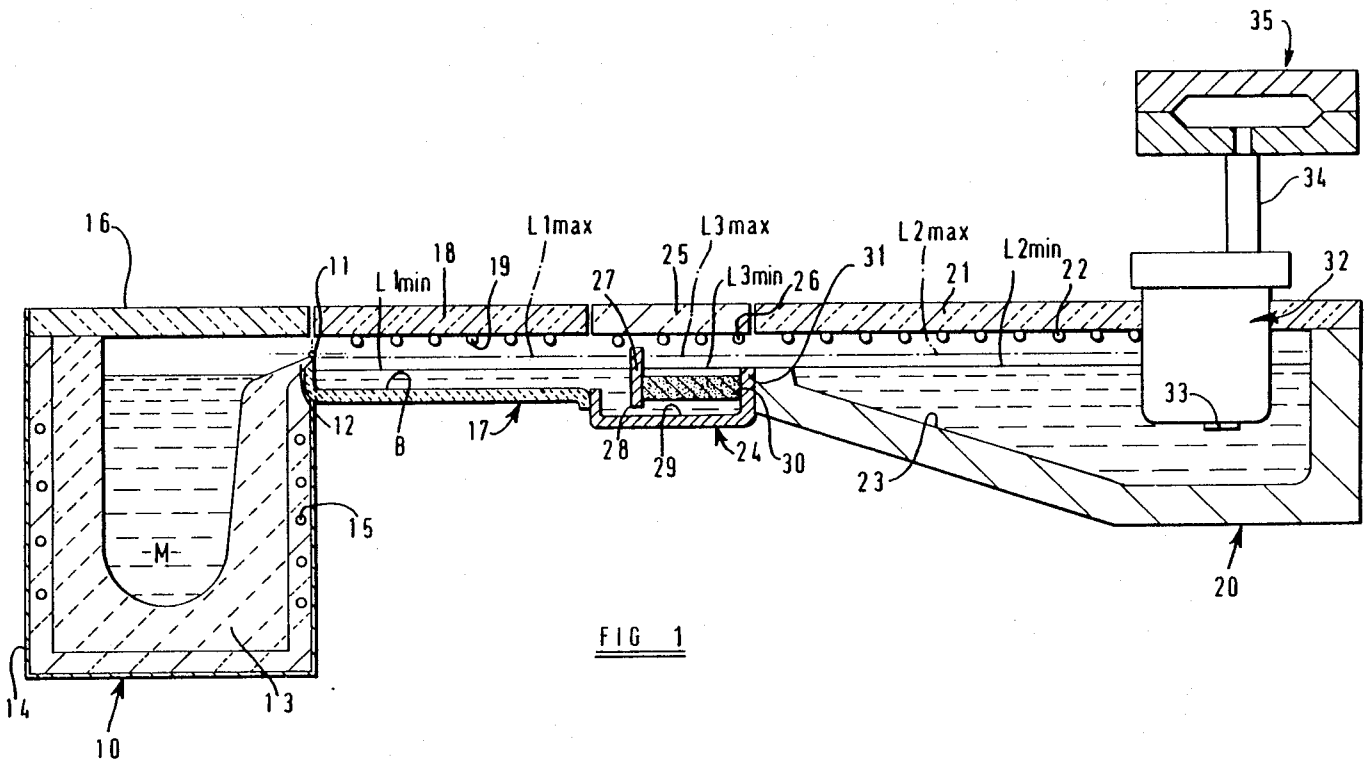
FIG. 1 is a diagrammatic cross-sectional view through an aluminium/aluminium alloy melting and casting apparatus embodying the invention.

Referring to FIG.1, the apparatus comprises a melting vessel 10 comprising a conventional lip action tilting type furnace. The furnace is mounted for tilting movement about a horizontal axis 11 coincident with a pouring lip 12 of the furnace. Metal M is melted and maintained molten within a refractory lining 13 within an outer steel casing 14. The furnace is heated electrically by means of an induction coil 15 and has an insulated lid 16.

A ceramic launder 17, provided with a lid 18 having electric radiant heating elements 19 therein, extends from the lip 12 to a casting vessel 20. The casting vessel 20 comprises a holding furnace having a lid 21 with further electric radiant heating elements 22 therein and has a relatively large capacity, in the present example 1 ton. The casting vessel is of generally rectangular configuration in plan view but has a sloping hearth 23 (to maximise its area at small volume) extending towards the launder 17.

Interposed between the launder 17 and the filling spout 23 is a filter box 24 provided with a lid 25 having electric radiant heater elements 26. A weir 27 extends between side walls of the filter box 24 and has a bottom end 28 spaced above the bottom 29 of the filter box. A replaceable filter element 30 is positioned between the weir 27 and the downstream end wall 31 of the filter box and is made of a suitable porous refractory material.

A pump 32 is positioned in relation to the casting vessel 20 so that an inlet 33 of the pump will be immersed in molten metal within the casting vessel and has a riser tube 34 which extends to a casting station so as to permit of uphill filling of a mould 35 thereat. The mould 35 is preferably a chemically bonded sand mould and the sand may comprise silica, olivine, chamotte, zircon, quartz sand, or synthetic material such as silicon carbide or iron or steel slot but preferably the sand content of the mould comprises substantially 100% zircon sand.

When the apparatus is in use, as metal is pumped by the pump 32 to make a casting, the level $L_2$ of the top surface of the metal in the casting vessel 20 falls from a maximum height $L_2$ max. to a minimum height $L_2$ min. Metal M melted in the melting furnace 10 is poured therefrom into the launder 17 and hence via the filter 30 into the casting vessel 20 so as to maintain the level $L_2$ of the top surface of the metal in the casting vessel between the above described limits $L_2$ max. and $L_2$ min. The level $L_1$ of the top surface of the molten metal in the launder 17 is maintained at the same height as the level $L_2$ as is the level $L_3$, in the filter box. The axis 11 about which the melting furnace vessel is tilted is positioned so that, in the present example, the top surface of the metal as it leaves the melting vessel is 100mm above the minimum height to which it is intended that the levels $L_1$ min.–$L_3$ min., should fall in use, so that even when the levels $L_1$–$L_3$ fall to the minimum predetermined value, the distance through which the metal falls freely is limited to 100mm.

Whilst a height of 100mm is the distance in the above example, if desired, the distance may be such that during pouring the level of the top surface of the metal leaving the furnace is at a maximum distance of 200mm above the levels $L_1$ min.–$L_3$ min. but with some deterioration in casting quality whilst still presenting improved quality compared with known methods in general use.

By providing the casting vessel with a relatively large surface area, the levels $L_1$–$L_3$ can be maintained within ±50mm of a predetermined mean height approximately 50mm below the axis 11 since filling of a predetermined number of moulds, such as the mould 35, by the pump 32, does not cause the levels $L_1$–$L_3$ to fall outside the above mentioned range. In the present example, where the casting vessel has a capacity of 1 ton 20 moulds each of 10 kilos capacity can be filled with a fall in level so that said distance increases from a minimum at 50mm above the mean height to said maximum distance at 50mm below said mean height before it is necessary to top up the casting vessel from the melting vessel 10. In the present example, approximately 1.5 hours of casting automobile engine cylinder heads can be performed before top up is necessary. Topping up of the casting vessel from the melting vessel 10 can be performed without interruption of the casting operation.

The above described example is a process which is capable of high and continous productive capacity in which turbulence and its effects are substantially eliminated and from which high quality castings are consistently produced. This is because the only free fall of metal through the atmosphere occurs over the relatively small distance from the lip 12 of the melting vessel into the launder 17 and in the present example, the maximum distance through which the metal can fall is 100mm, although as mentioned above in other examples the maximum distance may be up to 200 mm which is a relatively small distance in which relatively little oxide is created and such oxide that is created is filtered out by the filter element 30.

As mentioned above, the element 30 is removable and in the present example is replaced approximately at every 100 tons of castings, but of course the filter element may be replaced more of less frequently as necessary.

In the present example the pump 22 is a pneumatic type pump.

If desired, the pump may be of the electromagnetic type or any other form of pump in which metal is fed against gravity into the mould without exposing the metal to turbulence in an oxidising atmosphere.

Although the melting vessel 10 has been described as being of the lip action tilting type furnace, other forms of furnace may be provided if desired, for example of the dry sloping hearth type heated by a radiant roof. In this case, metal ingots or scrap placed upon the hearth melt and the molten metal trickles down into the launder 17 and thus never suffer free fall through the atmosphere since the hearth extends to the minimum height $L_1$ min. of the level $L_1$. If desired the hearth may terminate at a distance above said minimum height which is at or less than said maximum distance so that although some free fall through the atmosphere occurs, it is not sufficient to create excessive turbulence.

Irrespective of the nature of the melting vessel, if desired more than one melting vessel may be arranged to feed into the casting vessel either by feeding into individual launders or into a multi-armed launder. Further alternatively, the melting vessel or vessels may be arranged to discharge directly into the casting vessel the metal being directed through a replaceable filter element during its passage from the or each melting vessel to the casting vessel.

In the example described above and illustrated in FIG. 1, the launder has a bottom surface B which is below the lowest level $L_2$ min. to which the top surface of the metal in the casting vessel will fall in use and thus the launder 17 is maintained full of metal at all times during normal operation of the method and apparatus.

Figure 2:
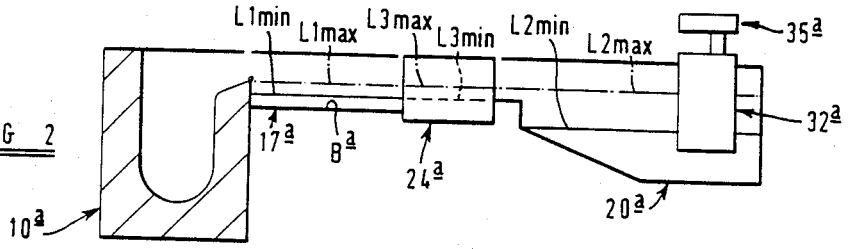
FIGS. 2 to 6 are simplified diagrammatic cross-sectional views through modifications of the apparatus shown in FIG. 1 and in which the same reference numerals are used as are used in FIG. 1 but with the subscript a to e respectively.

However, if desired, and as illustrated diagrammatically in FIG. 2, the launder 17*a* may have a bottom surface Ba which is above the lowest level $L_2$ min. to which the top surface of the metal in the casting vessel 20*a* may fall. In this case, assuming that the metal is poured from the melting vessel 10*a* batchwise, then the launder will empty of metal after pouring of a batch of molten metal.

Figure 3:
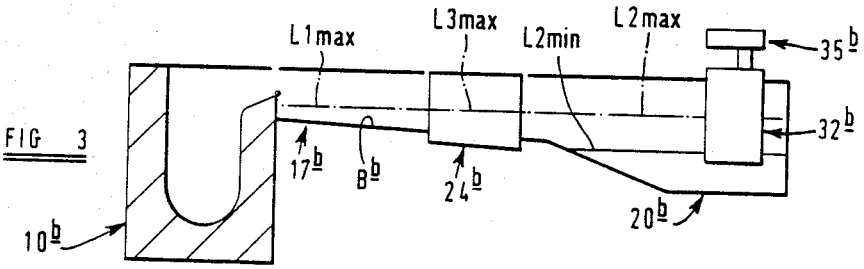
Figure 4:
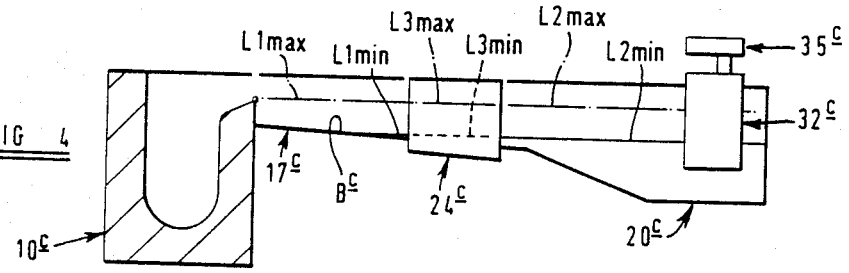

In a further example illustrated in FIG. 3, the launder 17*b* has a bottom surface Bb which whilst being rectilinear in longitudinal cross-section is inclined to the horizontal. The launder 17*b* may be arranged so that the whole of the bottom surface Bb is above the lowest level $L_2$ min. to which the top surface of the metal in the casting vessel 20*b* falls in use, or as shown in FIG. 4 only part of the bottom surface Bc may be above this level $L_2$ min.

Figure 5:
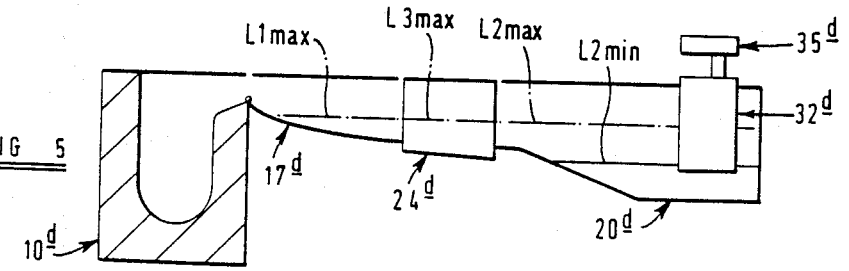
Figure 6:
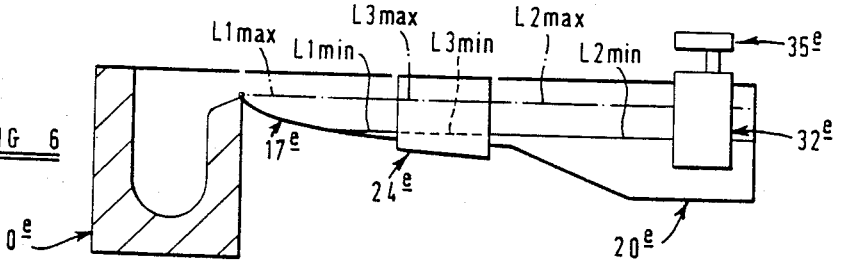

In a still further alternative, the launder 17*d* may be of such configuration that the bottom surface Bd is curved in longitudinal cross-section to present an entry part which is more inclined to the horizontal and an exit part which lies nearly horizontal as shown in FIG. 5 (or horizontal if desired). In this case, metal leaving the melting vessel first engages a part of the launder 17*d* which is more aligned with the direction of metal fall than other parts of the launder 17*d*, or is the case with the launders illustrated in the previous Figures, whilst the exit part of the launder lies substantially horizontal thus contributing to a relatively low metal velocity as metal leaves the launder and enters the casting vessel. The exit part of the launder 17*d* may be above the minimum level $L_2$ min. of the top surface of the metal in the casting vessel 20*d* as shown in FIG. 5 or, as shown in FIG. 6, below the level $L_2$ min. in the casting vessel 20*e*.

Figure 7:
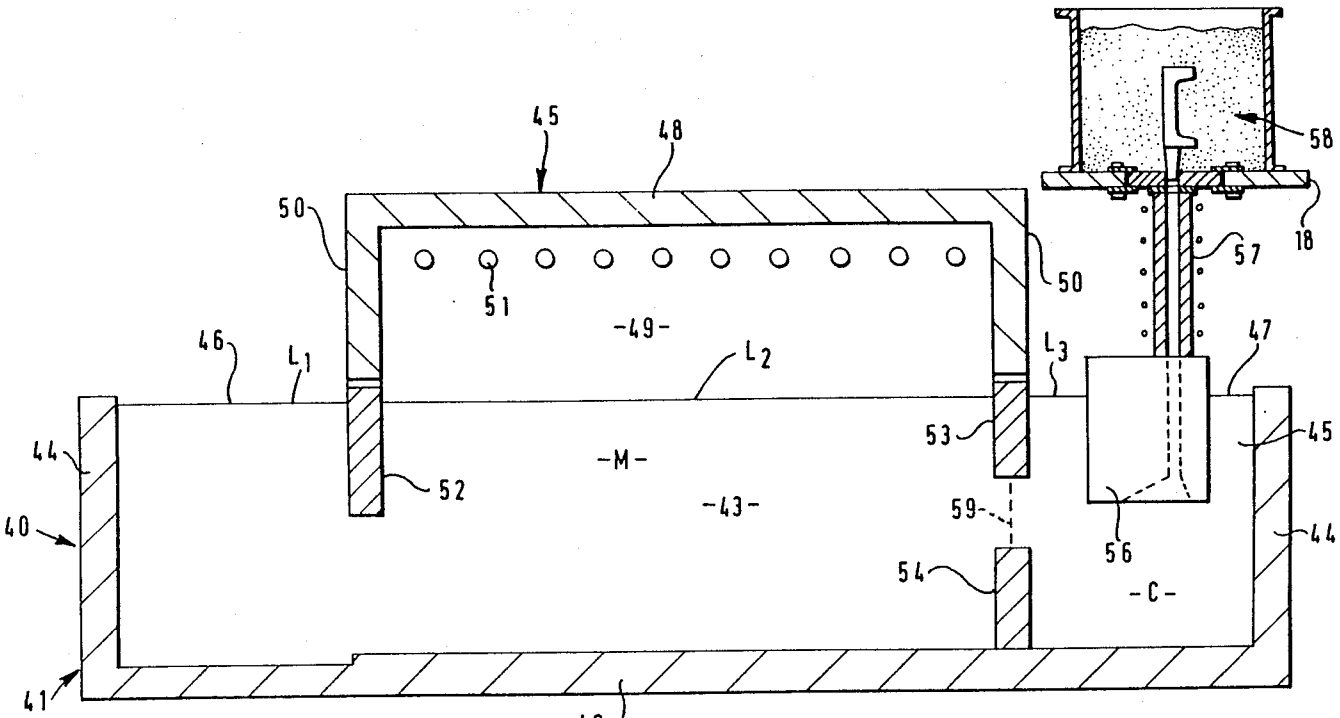
FIG. 7 is a diagrammatic cross-sectional view through another melting and casting apparatus embodying the invention.

Referring to FIG. 7, there is shown another apparatus embodying the invention which, unexpectedly, produced even better results than are achieved with the apparatus described hereinbefore. In this embodiment there is provided a melter/holder furnace 40 comprising a refractory lined vessel 41 having a generally rectangular base 42 and vertical side and end walls 43, 44 respectively. A roof 45 extends across the whole width of the vessel 41 but in its lengthwise direction stops short of the end walls 44 to provide a charging well 46 and a pump well 47 at opposite ends of the vessel 41. The roof 45 comprises a generally horizontal rectangular top part 48 and vertical side and end walls 49, 50 respectively. The roof 45 comprises a suitable refractory material and within the roof are provided electrical radiant heater 51.

The termperature of the heaters 51 and a number thereof and the area of the top part 48 of the roof are arranged so as to provide sufficient heat to melt ingots fed into the vessel 41 at the charging well 46 and to maintain the metal molten in the remainder of the vessel.

A downwardly depending refractory wall 52 is provided at the charging well end of the vessel 41 and downwardly depending and upwardly extending refractory walls 53, 54 are provided at the pump well end of the vessel. There is, therefore, defined between the wall 52 and the walls 53, 54 a region of the vessel 41 which constitutes a melting vessel M whilst there is defined between the walls 53, 54 and the wall 44 a region of the vessel 41 which constitutes a casting vessel C. A pump 56 is provided in the casting vessel C and in the present example the pump 56 is an electro-magnetic pump which pumps metal from the casting vessel C through a riser tube 57 which extends to a casting station so as to permit of uphill filling of a mould 58. The mould is preferably made in the same way as in the previously described embodiments.

If desired a filter 59 may be provided between the walls 53, 54 to filter metal entering the casting vessel C from the melting vessel M.

In use of the embodiment described with reference to FIG. 7, as metal is pumped by the pump 56 to fill the mould 58, a corresponding, relatively small, amount of solid metal is added to the charging well 46. Consequently the levels of the top surface of the metal, $L_1$, $L_2$, $L_3$, in the charging well melting vessel M and casting vessel C respectively remain substantially constant. As metal is pumped by the pump out of the casting vessel C there will be a tendency for a very small fall in the level $L_3$ but this will be simultaneously compensated by inflow of metal from the melting vessel M which would tend to cause a corresponding small fall in the level $L_2$ but this would be compensated for by inflow of metal from the charging well 36. If extra solid metal were not added to the charging well 46 then, of course, there would be a small fall in the levels $L_1$, $L_2$, $L_3$ but by adding a corresponding amount of solid metal to the casting well 46 the levels $L_1$, $L_2$, $L_3$ are maintained substantially constant at all times. If the apparatus were operated so that a number of castings were made without adding metal, then, whilst the amount of metal flow under gravity from the melting vessel M to the casting vessel C would be such as to ensure quiescent flow so that high quality castings are achieved, when a relatively large amount of metal is added to the casting well 46 this would cause a relatively great amount of metal flow into the melting vessel M and subsequently into the casting vessel C which could create turbulence and thus cause oxides to pass into the casting vessel C. It is for this reason that it is preferred to add metal to the casting well at substantially the same rate as metal is pumped from the casting vessel C.

The apparatus described with reference to FIG. 1 and that described with reference to FIG. 7 were used to make a plurality of test bars. The test bars were standard DTD test bars and were cast in LM25 TF alloy. When using the apparatus of FIG. 1 the melting vessel was positioned at different heights above the casting vessel to investigate, together with the same level of melting vessel and casting vessel provided by the embodiment of FIG. 7, the effect of different difference in height between the melting vessel and casting vessel on the mechanical properties of the test bars.

Figure 8:
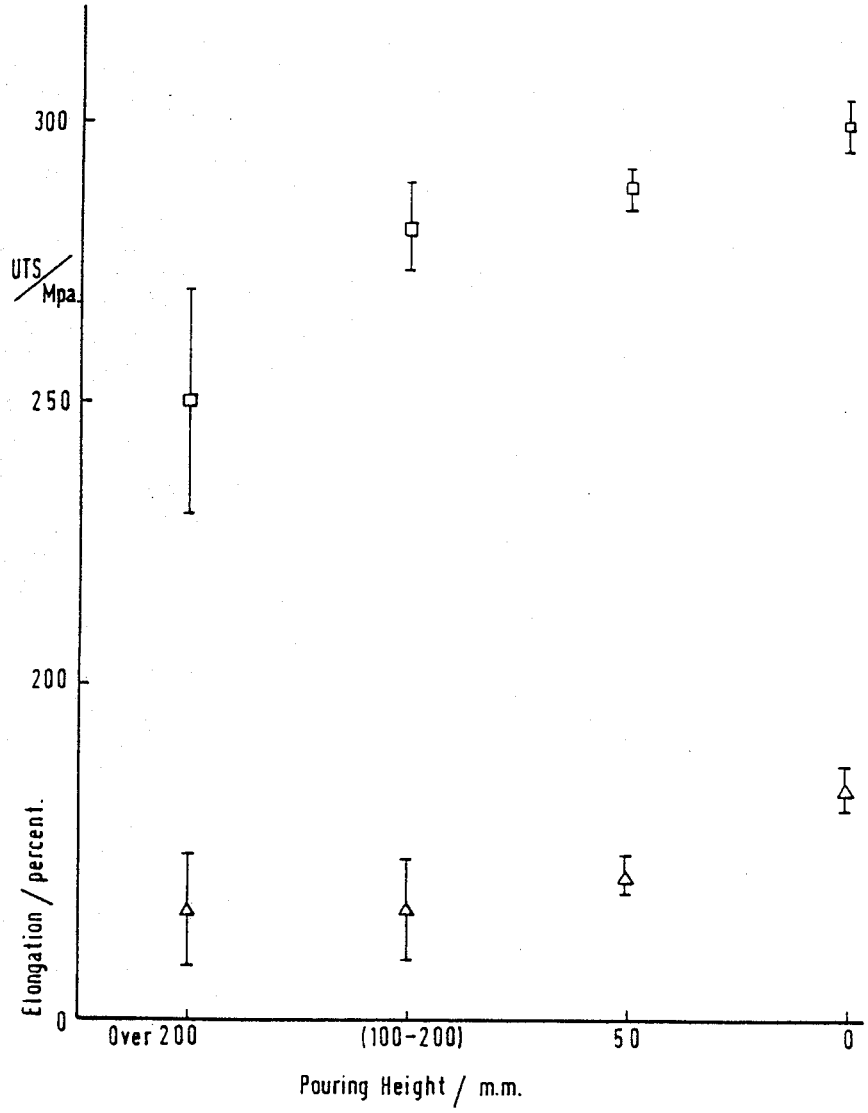
FIG. 8 is a graph showing how the properties of castings improves unexpectedly with decrease in difference in height between the melting vessel and the casting vessel.

The results of the tests are represented in graphical form in FIG. 8. It will be seen that, when the difference in height exceeded 200 mm, there is a relatively low ultimate tensile strength and a relatively great spread in ultimate tensile strength between the samples. Thus, not only is the ultimate tensile strength relatively low, but is also unpredictable which creates obvious problems for users of castings. Where the difference in height lay in the range 100 mm to 200 mm, a significant increase in ultimate tensile strength occurs with a significantly reduced spread.

Substantially the same ultimate tensile stress and spread occurs when the difference is 50 mm but it will be noted that there is an improvement in the elongation properties. However, when the difference in height is zero then there is an unexpected and dramatic improvement, not only in ultimate tensile stress, but also in elongation. Indeed the minimum elongation is more than doubled. This is particularly important since acceptance of a component made by the method depends on satisfying a specified minimum elongation.

The method and apparatus of the present invention are suitable for low melting point alloys such as those of lead, bismuth and tin; those of intermediate melting points such as magnesium and aluminium; and those of higher melting points such as copper, aluminium-bronzes and cast irons. It is anticipated that steel may also be cast by the method and apparatus of the present invention although expensive refractories will be required.

We have found that unexpectedly good results were obtained when the method and/or apparatus described above was used to cast an aluminium alloy lying in the composition range specified above.

An alloy having the following composition was made and tested

| | | | | | |
|---|---|---|---|---|---|
| Si | 10.27 | Ni | 0.13 | Cr | 0.05 |
| Cu | 2.91 | Zn | 1.03 | Usual Incidentals | 0.09 (Each incidental) |
| Mg | 0.45 | Pb | 0.06 | | |
| Fe | 0.70 | Sn | 0.03 | Aluminium | Balance |
| Mn | 0.34 | Te | 0.02 | | |

This alloy was found to have excellent castability and it was found possible to make castings containing 3 mm thin webs and heavy unfed sections, all with near perfect soundness (less than 0.01 volume percent porosity) in cylinder head castings, cast at temperatures as low as 630° C. At these temperatures, power for melting is minimised and oxidation of the melt surface is so slight as to cause little or no problems during production.

The tolerance of the alloy towards large amounts of Zn, and comparatively high levels of Pb and Sn is noteworthy.

The machinability of the alloy when sand cast by the process described hereinafter is found to be very satisfactory. Surface finish levels of 0.3 m are obtained in one pass with diamond tools. It qualifies for a Class B rating on the ALAR/LMFA Machinability Classification 1982. No edge degradation by cracking or crumbling was observed: edges were preserved sharp and deformed in a ductile manner when subjected to abuse.

A DTD sand cast test bar of the above described alloy was made, by the process described hereinafter, and when tested was found to have the properties listed in Table 1 under the heading "Cosalloy 2" where Line 1 gives the properties when the test bar was "as cast", Line 2 when aged only at 205° C. for two hours and Line 3 when solution treated for one hour at 510° C., quenched and aged for 8 hours at 205° C.

Also shown in Table 1 are the mechanical properties of DTD sand cast test bars of a number of known Si, Cu, Mg type alloys namely those known as LM13, LM27, LM21 and LM4 in British Standard BS1490.

Table 1 also shows the mechanical properties of DTD chill test cast bars of a number of other known Si Cu Mg type alloys, i.e. LM2, LM24 and LM26 which are available only as either pressure die casting or gravity die casting alloys.

TABLE 1

| | | 0.2 PS MPa | UTS MPa | El % | Brinell Hardness HB |
|---|---|---|---|---|---|
| Cosalloy 2 | (1) | 135 | 195 | 1.3 | 95 |
| | (2) | 190 | 215 | 0.9 | 100 |
| | (3) | 315 | 320 | 0.7 | 125 |
| LM13 | Fully Heat Treated | 200 | 200 | 0 | 115 |
| LM27 | As Cast | 90 | 150 | 2 | 75 |
| LM21 | As Cast | 130 | 180 | 1 | 85 |
| LM4 | As Cast | 100 | 150 | 2 | 70 |
| LM4 | Fully Heat Treated | 250 | 280 | 1 | 105 |
| LM2 | As Cast | 90 | 180 | 2 | 80 |
| LM24 | As Cast | 110 | 200 | 2 | 85 |
| LM26 | Aged | 180 | 230 | 1 | 105 |

It will be seen that only the chill cast test bars approach the results achieved by the alloy above described which, it is to be emphasised, was cast in sand. The test results stated in Table 1 with the alloy above described were achieved without recourse to modification, that is treatment with small additions of alkali or alkaline-earth elements, such as sodium or strontium, to refine the silicon particle size in the casting. This treatment usually confers appreciable extra strength and toughness, although is difficult to control on a consistent basis. The properties of the known alloys given in Table 1 have been achieved by this troublesome and unreliable method. The properties of the alloy above described were achieved without such recourse, and so having the advantages of being more reliable, easier and cheaper.

It is believed that even better properties will be achieved with an alloy as described above if modified.

Table 2 shows results of further tests as follows:

Group 1:

DTD test bars produced by casting uphill into zircon sand moulds.

Line 1a(i) Cosalloy 2—as cast.

Line 1a(ii) Cosalloy 2—aged.

Line 1b(i) LM25—as cast.

Line 1b(ii) LM25—solution treated and aged.

Group 2:

DTD test bars produced by gravity die casting by hand into zircon sand moulds.

Line 2a(i) Cosalloy 2—as cast.

Line 2a(ii) Cosalloy 2—aged.

Line 2b(i) LM25—as cast.

Line 2b(ii) LM25—solution treated and aged.

Group 3:

DTD test bars produced by gravity die casting by hand into silica sand moulds.

Line 3a(i) Cosalloy 2—as cast.

Line 3a(ii) Cosalloy 2—aged.

Line 3b(i) LM25—as cast

Line 3b(ii) LM25—solution treated and aged.

In all groups, Cosalloy 2 was aged for four hours at 200° C. and LM25 was solution treated for twelve hours at 530° C., polymer quenched and aged for two hours at 190° C.

The results given in Table 2 are the average of a number of individual tests. When the tests which led to the results given in Group 1 were made, a standard mean deviation of less than 3% or 4% was observed.

The tests of Groups 2 and 3 were intended to simulate conventional sand casting techniques and a standard mean deviation of up to 10% was observed. The figures given in Groups 2 and 3, because of the very great variability, are the average of tests which were performed with extreme care being taken during casting, and thus are indicative of the best results attainable by casting by hand.

TABLE 2

| | | 0.2 PS Mpa | UTS Mpa | EL % |
|---|---|---|---|---|
| 1 | a(i) | 130 | 195 | 1.3 |
| | a(ii) | 205 | 220 | 0.8 |
| | b(i) | 105 | 160 | 3.3 |
| | b(ii) | 270 | 300 | 1.8 |
| 2 | a(i) | 113 | 154 | 1.1 |
| | a(ii) | 158 | 192 | 1.0 |
| | b(i) | 97 | 149 | 2.1 |
| | b(ii) | 268 | 288 | 1.1 |
| 3 | a(i) | 110 | 151 | 1.1 |
| | a(ii) | 168 | 197 | 0.9 |
| | b(i) | 102 | 142 | 1.7 |
| | b(ii) | 261 | 281 | 1.1 |

These figures demonstrate:

(a) the considerably better properties achieved by the method embodying the invention compared with conventional methods as will be seen by comparing the figures in Group 1 with those in Groups 2 and 3;

(b) the considerably better properties achieved by an alloy as described above compared with a comparable known alloy as will be seen by comparing the figures in Lines 1a(i)(ii); 2a(i) (ii); 3a(i)(ii) with the remaining figures;

(c) the pre-eminence of the properties achieved using both the alloy and the method/apparatus described above as will be seen by comparing the figures in Lines 1a(i)(ii) with the remaining figures.

The test bars of the alloy embodying the invention and the test bars of LM25 referred to as made by "casting uphill" were cast using the method and apparatus described above with reference to FIG. 1.

In this specification compositions are expressed in % by weight.

I claim:

1. A method of melting and casting metal comprising the steps of melting metal in a melting vessel, advancing a quiescent flow of said molten metal, by gravity, along the whole of a path from said melting vessel into a casting vessel to provide a reservoir of molten metal which dwells in said casting vessel, said path being defined to maintain the level of the top surface of the metal as the metal leaves the melting vessel above the top surface of the metal in the casting vessel by not more than a distance of 200 mm and sequentially pumping a discrete volume of said molten metal against gravity from the casting vessel into each of a plurality of individual moulds.

2. A method as claimed in claim 1 wherein said distance is in the range 100–50 mm.

3. A method as claimed in claim 1 wherein the method includes the steps of directing metal from the melting vessel into a launder and from the launder into the casting vessel, the launder being disposed to maintain the level of metal in the launder at a level which is below the level of the top surface of the metal as it leaves the melting vessel and is at or above the level of the top surface of the metal in the casting vessel.

4. A method as claimed in claim 1 wherein said distance is substantially zero.

5. A method as claimed in claim 4 wherein metal is added to the melting vessel at substantially the same rate as metal is pumped from the casting vessel.

6. An apparatus for melting and casting metal comprising a melting vessel, a casting vessel, means defining a path for quiescent flow of molten metal under gravity and along the whole of the path from said melting vessel to said casting vessel so that the level of the top surface of said molten metal as said molten metal leaves said melting vessel is above the top surface of the molten metal in said casting vessel by not more than a distance of 200 mm and a pump to pump sequentially a discrete volume of metal against gravity from the casting vessel into each of a plurality of individual moulds.

7. An apparatus as claimed in claim 6 wherein said distance is substantially zero.

8. An apparatus as claimed in claim 6 wherein the apparatus includes a launder having an entry end located so that metal leaving the melting vessel may enter the launder thereat and an exit end whereby the metal may flow from the launder to the casting vessel, the launder being disposed to maintain the level of the top surface of the metal in the launder at a level which is below the level of the top surface of the metal as it leaves the melting vessel and is at or above the level of the top surface of the metal in the casting vessel.

9. An apparatus as claimed in claim 6 wherein the melting vessel comprises a lip action tilting vessel.

10. An apparatus as claimed in claim 6 wherein the casting vessel and the melting vessel are provided by different, intercommunicating, regions of a common vessel so that said distance is substantially zero.

11. An apparatus as claimed in claim 6 wherein filter means are incorporated in the metal flow path from the melting furnace to the casting vessel.

12. A method as claimed in claim 1 wherein the metal is an aluminium alloy lying in the following composition range:

| | | |
|---|---|---|
| Si | 10.0 | 11.5 |
| Cu | 2.5 | 4.0 |
| Mg | 0.3 | 0.6 |
| Fe | 0 | 0.8 |

-continued

| | | | |
|---|---|---|---|
| Mn | 0 | 0.4 | |
| Ni | 0 | 0.3 | |
| Zn | 0 | 3.0 | |
| Pb | 0 | 0.2 | |
| Sn | 0 | 0.1 | |
| Ti | 0 | 0.08 | |
| Cr | 0 | 0.05 | |
| Usual Incidentals | 0 | 0.09 | (each incidental) |
| Aluminium | Balance. | | |

13. A method as claimed in claim 12 wherein the silicon, copper and magnesium contents are as follows:

| | | |
|---|---|---|
| Si | 10.5 | 11.5 |
| Cu | 2.5 | 3.5 |
| Mg | 0.3 | 0.5 |

14. A method as claimed in claim 1 wherein the mould is made of chemically bonded zircon sand.

* * * * *